US008878829B2

(12) United States Patent
Xiao

(10) Patent No.: US 8,878,829 B2
(45) Date of Patent: Nov. 4, 2014

(54) LIQUID CRYSTAL DISPLAY AND COMMON ELECTRODE DRIVE CIRCUIT THEREOF

(75) Inventor: Xiangchun Xiao, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 511 days.

(21) Appl. No.: 12/730,373

(22) Filed: Mar. 24, 2010

(65) Prior Publication Data

US 2010/0245326 A1 Sep. 30, 2010

(30) Foreign Application Priority Data

Mar. 25, 2009 (CN) ..... 2009 1 0080700

(51) Int. Cl.
*G09G 5/00* (2006.01)
*G09G 3/36* (2006.01)

(52) U.S. Cl.
CPC ..... *G09G 3/3655* (2013.01); *G09G 2300/0426* (2013.01); *G09G 3/3677* (2013.01); *G09G 2320/0247* (2013.01); *G09G 2320/0223* (2013.01); *G09G 2310/0281* (2013.01); *G09G 2310/066* (2013.01); *G09G 2320/0219* (2013.01)
USPC ..... 345/206

(58) Field of Classification Search
CPC ..... G09G 3/3655
USPC ..... 345/211, 206
See application file for complete search history.

(56) References Cited

U.S. PATENT DOCUMENTS 5,831,605 A * 11/1998 Yasui et al. ..... 345/211
6,229,510 B1 * 5/2001 Kim et al. ..... 345/87
6,392,626 B1 * 5/2002 Moon ..... 345/94
6,862,013 B2 * 3/2005 Takeuchi et al. ..... 345/211
7,502,020 B2 * 3/2009 Kim et al. ..... 345/211
8,044,900 B2 * 10/2011 Kim et al. ..... 345/87
8,089,435 B2 * 1/2012 Tu ..... 345/87
8,228,287 B2 * 7/2012 JaeHun ..... 345/95
2001/0011984 A1 * 8/2001 Hong ..... 345/92
2002/0011982 A1 * 1/2002 Takeuchi et al. ..... 345/92
2004/0160400 A1 * 8/2004 Hong ..... 345/87
2004/0164943 A1 * 8/2004 Ogawa et al. ..... 345/92

(Continued)

FOREIGN PATENT DOCUMENTS

CN 87106311 A 3/1988
EP 0 260 747 A1 3/1988

(Continued)

OTHER PUBLICATIONS

Japanese Office Action dated Aug. 19, 2013; Appln. No. JP2010-070127.

(Continued)

*Primary Examiner* — Adam J Snyder
(74) *Attorney, Agent, or Firm* — Ladas & Parry LLP

(57) ABSTRACT

A common electrode drive circuit for a liquid crystal display, comprising a plurality of output terminals connected to a plurality of common voltage input terminals of a common electrode layer of the liquid crystal display and adapted for inputting common voltages into the plurality of common voltage input terminals, the common electrode layer driving liquid crystal together with pixel electrodes of the liquid crystal display. The common voltages input by the plurality of output terminals decrease gradually from a data-line beginning end for data signal input to a data-line tail end for data signal input of the liquid crystal display.

7 Claims, 7 Drawing Sheets

(56) References Cited

U.S. PATENT DOCUMENTS

| | | | | |
|---|---|---|---|---|
| 2004/0169627 | A1* | 9/2004 | Hong | 345/89 |
| 2005/0156840 | A1* | 7/2005 | Kim et al. | 345/87 |
| 2007/0002005 | A1* | 1/2007 | Kim et al. | 345/103 |
| 2008/0117148 | A1* | 5/2008 | Tu | 345/87 |

FOREIGN PATENT DOCUMENTS

| | | | | | |
|---|---|---|---|---|---|
| JP | 10-039325 | A | | 2/1998 | |
| JP | 11-133379 | A | | 5/1999 | |
| JP | 2002-108310 | A | | 4/2002 | |
| KR | 1999-0013234 | A | | 2/1999 | |
| KR | 20020057408 | A | | 7/2002 | |
| KR | 20040021384 | A | | 3/2004 | |
| KR | 10-2005-033670 | | * | 4/2005 | G09G 3/36 |

OTHER PUBLICATIONS

Japanese Office Action dated Jul. 7, 2014; Appln. No. 2010-070127.

* cited by examiner

LIQUID CRYSTAL DISPLAY AND COMMON ELECTRODE DRIVE CIRCUIT THEREOF

BACKGROUND

The present invention relates to a common electrode drive circuit and a liquid crystal display.

At present, LCDs (Liquid Crystal Displays), especially TFT-LCDs (Thin Film Transistor-Liquid Crystal Displays), are increasingly used by virtue of their lightness, slimness, portability and etc. However, flickering images often occur in conventional LCDs in use, which affects display quality of the LCDs. Below a brief explanation to the generation of flickering images in a LCD is given.

A LCD comprises a plurality of pixels arranged in a matrix. FIG. 1 is a schematic diagram of an equivalent circuit for each pixel in a LCD. As shown in FIG. 1, when a TFT-LCD is in operation, on an array substrate, a gate switching-on ("ON") voltage is applied to a gate electrode g connected with a gate line Gn, to turn on the TFT, so that a data voltage for displaying image on a data line Dm is applied onto a drain electrode d through a source electrode s. The drain electrode d is connected with a pixel electrode p, and thus the above-mentioned data voltage is applied onto the pixel electrode p through the drain electrode d to generate a pixel electrode voltage. A common electrode layer is provided on a color filter substrate, and a liquid crystal capacitor Clc is created between the pixel electrode p and the common electrode layer on which a common voltage Vcom is applied. The liquid crystal capacitor Clc exerts an electrical field on liquid crystal molecules to orientate the liquid crystal molecules. In order to prevent liquid crystal material from deterioration, the pixel electrode voltage may be reversed with respect to the common voltage, so as to drive the deflection of liquid crystal material with a reverse driving method in which the driving voltage is switched between the positive and negative values repeatedly, to control transitivity of light and display images of different grey levels. During reverse driving, if it is desired to make grey levels for an image and its reversed image to be consistent, differences between the pixel electrode voltage and the common voltage Vcom for the image and its reversed image have to be close to each other in absolution value. Otherwise, flickering images will occur.

As a parasitic capacitor Cgd is generated between the gate electrode g and the drain electrode d, obvious fluctuation of voltage generated when the gate line Gn is switched on and off will be applied to the pixel electrode p through the parasitic capacitor Cgd, causing a voltage jump $\Delta V$ in the pixel electrode voltage and affecting the precision of the eventual pixel electrode voltage.

FIG. 2 is a schematic waveform diagram showing the change in the pixel electrode voltage. As shown in FIG. 2, when the gate line is turned off, the gate voltage Vg may have a relative large voltage drop of about 10~40V, which will affect the pixel electrode voltage Vp through the parasitic capacitor to generate a voltage jump $\Delta V$, and such influence will exist all along until the gate line is turned on next time. Therefore, the influence of this voltage jump on displayed grey level can be noticed by a human's eye. When the gate line is turned on next time, the data voltage Vd reverses in polarity, so that the gate line is turned off again, and the voltage jump $\Delta V$ will cause the new pixel electrode voltage Vp to drop too. Accordingly, the pixel electrode voltage Vp is lower than the data voltage Vd, and the value by which the voltage drops is exactly the value of the voltage jump $\Delta V$ which is caused by the change in the gate voltage Vg through the parasitic capacitor. Thus, the phenomenon of flickering images occurs.

SUMMARY

An embodiment of the present invention provides a common electrode drive circuit for a liquid crystal display, comprising a plurality of output terminals connected to a plurality of common voltage input terminals of a common electrode layer of the liquid crystal display and adapted for inputting common voltages into the plurality of common voltage input terminals, the common electrode layer driving liquid crystal together with pixel electrodes of the liquid crystal display. The common voltages input by the plurality of output terminals decrease gradually from a data-line beginning end for data signal input to a data-line tail end for data signal input of the liquid crystal display.

Another embodiment of the present invention further provides a liquid crystal display, comprising: a liquid crystal panel comprising an array substrate and a color filter substrate disposed oppositely to each other with a liquid crystal layer sandwiched therebetween, the array substrate comprising a first substrate, a plurality of gate lines and a plurality of data lines crossing each other perpendicularly on the first substrate and a plurality of pixels; a gate driver and a data driver, the gate driver outputting gate signals to the gate lines, the data driver outputting data signals to the data lines, the gate driver being provided on one side of the gate lines and connected to each of the gate lines for inputting the gate signals; and a common electrode drive circuit according to an embodiment of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION OF THE EMBODIMENTS

Figure 1:
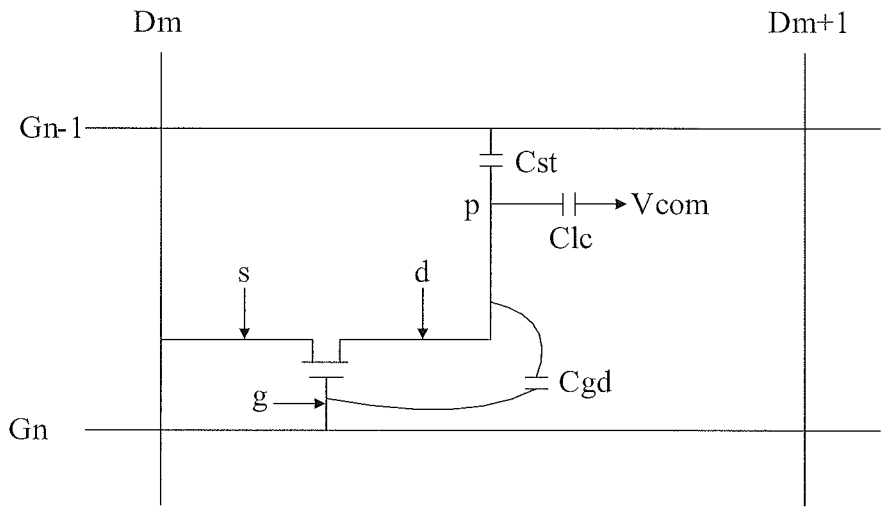
FIG. 1 is a schematic diagram of an equivalent circuit for each pixel in a LCD.
Figure 2:
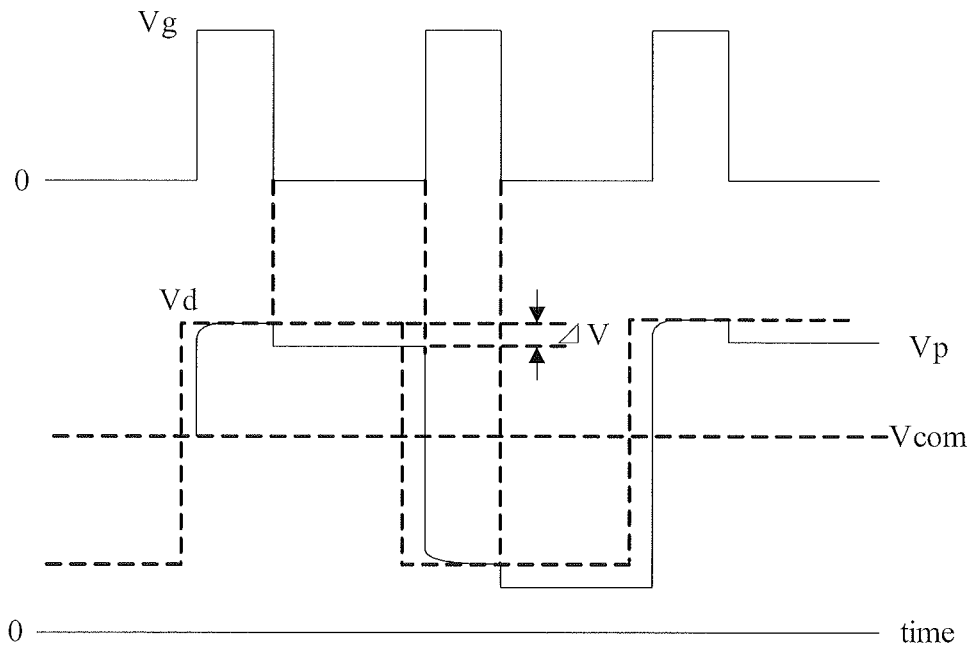
FIG. 2 is a schematic waveform diagram showing the change in the pixel electrode voltage.
Figure 3:
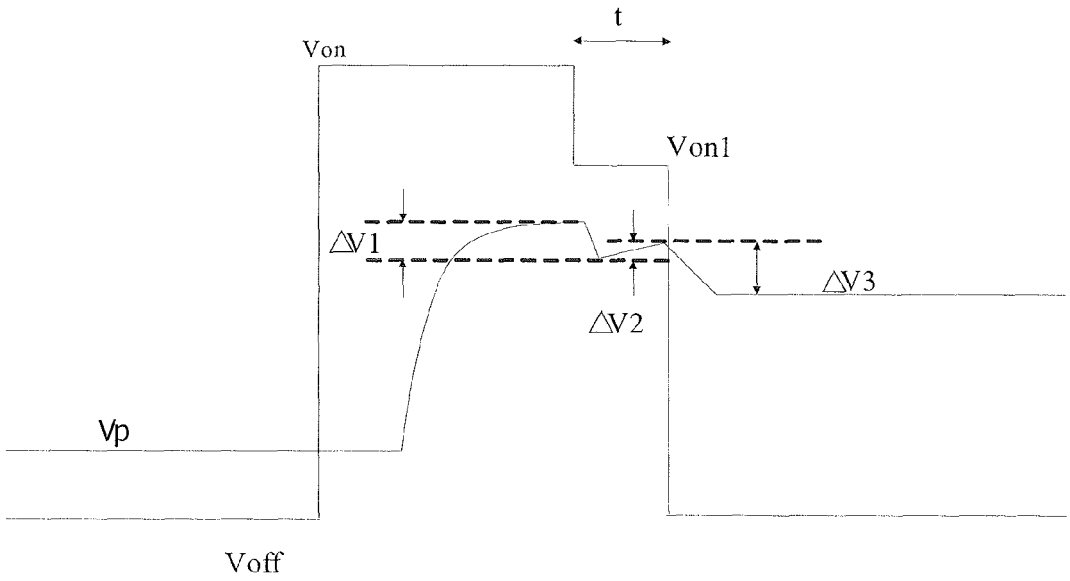
FIG. 3 is a schematic diagram of a MLG method.

A MLG (Multi-Level Gate) method can be used to solve the problem of flickering images. FIG. 3 is a schematic diagram of the MLG method. As shown in FIG. 3, this method is to make the voltage jump ΔV as small as possible. The voltage drop at the end phase of turnoff is reduced by lowering the gate switching-on voltage from Von to Voff step by step when the gate electrode is turned off, so that the voltage jump ΔV is made smaller, and its influence on display is reduced. The method can be carried out as follows: the gate voltage first is lowered from the maximum Von to an intermediate point Von1 and kept for a period of time t; during the time t, the pixel electrode is still charged by the data line, so that the pixel electrode voltage Vp first drops by ΔV1 and then increase by ΔV2; finally, the gate voltage is lowered from the intermediate point to a end point Voff, along with which the pixel electrode voltage Vp drops by ΔV3; and then the entire process is completed. Although the MLG method reduces the voltage jump ΔV to a certain extent and the phenomenon of flickering images is alleviated, it is still difficult to improve the quality of the overall image at the same time.

For the problem that the MLG method is still not able to improve an entire displayed image at the same time, the inventor learned from study that, on a displayed image on a LCD, voltage jumps at various places may be different, but the above-discussed MLG method applies the same common voltage to all the common electrodes, which can not be close to the pixel electrode voltages of all the pixels in absolute value, and consequently, can not make grey levels of an image and its reversed image to be consistent for all the pixels. Therefore, the phenomenon of flickering images will still occur to the LCD. Detailed explanation is as follows.

Voltage jumps for respective pixels on a displayed image of a LCD may be different. This is mainly caused by two factors, that is, RC (Resistance-Capacitance) characteristic of a gate line and RC characteristic of a data line, respectively. First, the influence of the RC characteristic of a gate line is explained. As electrical characteristic of a gate line includes a resistant component R and a parasitic capacitance component C, when a gate driver applies a selection voltage signal which switches on and off a gate onto a TFT through the gate line, the gate selection voltage will be delayed due to the RC characteristic of the gate line during the transmission of the voltage signal through the gate line, which makes the voltage actually obtained over the gate line drop to a certain extent when the selection voltage on the gate line is transmitted from the beginning end thereof to the tail end thereof. In the MLG technology, a voltage jump ΔV is calculated based on the following equations:

$$\Delta V = \Delta V1 - \Delta V2 + \Delta V3$$

wherein, $$\Delta V1 = Cgd*(Von - Von1)/(Cgd+Cst+Clc);$$

$$\Delta V2 = \Delta V1(1-\exp(-t/(R(Cst+Clc+Cgd)))),$$

$$\Delta V3 Cgd*(Von1 - Voff)/(Cgd+Cst+Clc).$$

From the above equations it can be seen that the RC characteristic of the gate line will make the ΔV1 and ΔV3 at the beginning end of the gate line higher than the ΔV1 and ΔV3 at the tail end of the gate line, and thus, cause the voltage jump ΔV from the beginning end of the gate line to the tail end of the gate line vary.

Second, the RC characteristic of the date line may also affect the voltage jump ΔV, because when the MLG technology is applied, the pixel electrode voltage will recover ΔV2 after the gate voltage is lowered from the maximum to an intermediate point and kept for a period of time since the date line can still charge the pixel electrode at this time, and as the RC characteristic of the data line, the RC value at the beginning end of the data line is smaller than the RC value at the tail end thereof, the ΔV2 at the beginning end of the data line is larger than the ΔV2 at the tail end.

Due to both of these two factors, voltage jumps ΔV for respective pixels of a LCD are different. Specifically, for a LCD of a single-side gate driving form, the voltage jump ΔV at the lower left side is the maximum, and the voltage jump ΔV at the upper right side is the minimum. That is, the voltage jumps ΔV change gradually within the display region of the LCD. For a LCD of a double-side gate driving form, differences in the influences of voltage change during the turning on and off of the gate line on the voltage jumps among different points of the gate line are negligible, and therefore only the influence of the data lines on the voltage jumps ΔV need to be considered.

From the above discussion, it can be seen that different common voltages can be applied onto the common electrode layer of a LCD according to the different voltage jumps ΔV of respective pixels of the LCD, to make differences in the common voltages of respective pixels as consistent as possible with differences in the voltage jumps at respective pixels, so that the entire display performance of the LCD can be improved at the same time. One example of this method is as follows: from a common electrode drive circuit, a plurality of output terminals are led out, which are connected to a plurality of common electrode input terminals of a common electrode layer and apply common voltages onto the plurality of common electrode input terminals; and the input common voltages are suitable so long as they gradually decrease from the data-line beginning end for data signal input to the data-line tail end for data signal input. On this basis, influence of the gate line can be further considered, making the input common voltages to gradually increase from the gate-line beginning end for gate signal input to the gate-line tail end for gate signal input.

Now, embodiments will be given to explain the present invention. It should be noted that in the following embodiments of the invention, the common voltages at the beginning end and the data-line tail end for data signal input and the beginning end and the gate-line tail end for gate signal input of the common electrode layer are different as examples; in other embodiments, different common voltages can also be applied to a middle position of the common electrode layer or any other positions of the common electrode layer, so long as the differences of the common voltages input at different common electrode input terminals of the common electrode layer are close in absolution value to the pixel electrode voltage differences of the pixels where the common electrode input terminals are located.

Figure 4:
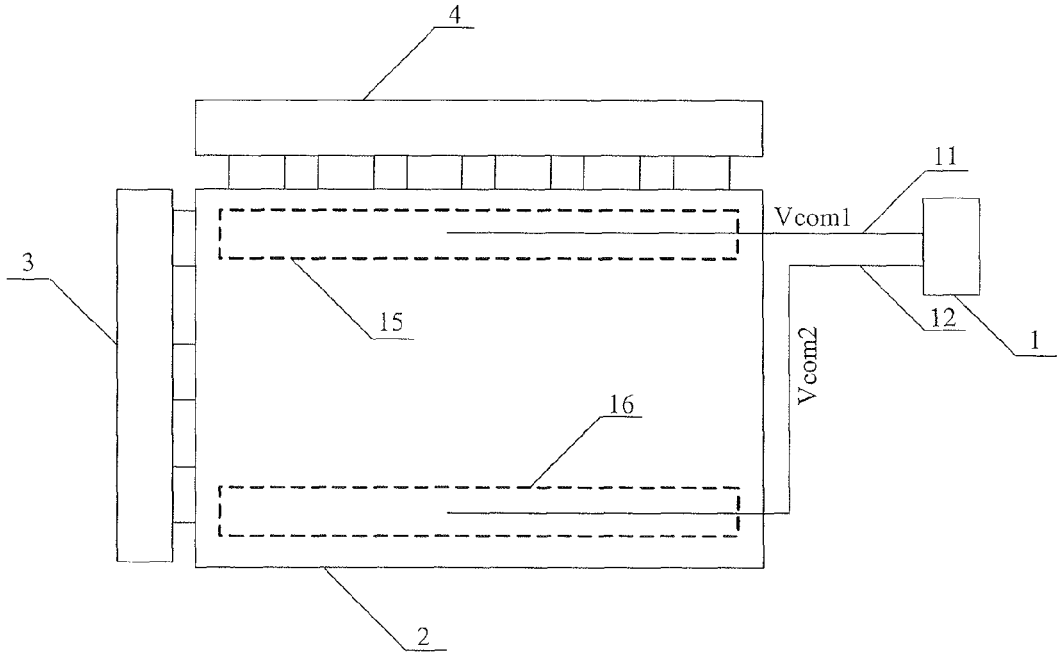
FIG. 4 is a schematic structural diagram of the first embodiment of the a common electrode drive circuit of the present invention.

FIG. 4 is a schematic structural diagram of the first embodiment of the common electrode drive circuit of the present invention. The common electrode drive circuit 1 of the present embodiment is connected to a liquid crystal panel 2. Specifically, it is connected to a common electrode layer in a color filter substrate of the liquid crystal panel 2. On the array substrate of the liquid crystal panel 2 are usually provided with data lines and gate lines which are crossed with each other perpendicularly. Data image signals output from a data driver 4 are input into one side of the data lines. The ends of the data lines to which the data signals are input can be called as the data-line beginning ends for data signal input, and then the other ends of the data lines can be called as the data-line tail ends for data signal input. Gate signals output from a gate driver 3 are input into one side of the gate lines. The ends of the gate lines to which the gate signals are input can be called as the gate-line beginning ends for gate signal input, and then the other ends of the gate lines can be called as the gate-line tail ends for gate signal input. In the liquid crystal panel 2, the color filter substrate and the array substrate are disposed oppositely to each other, and the common electrode layer is substantially parallel to a surface of the array substrate.

As shown in FIG. 4, the common electrode drive circuit 1 comprises a first output terminal 11 and a second output terminal 12. The first output terminal 11 and the second output terminal 12 output a first common voltage Vcom1 and a second common voltage Vcom2, respectively, and the second common voltage Vcom2 is smaller than the first common voltage Vcom1. The first output terminal 11 is connected to a first end 15 of the common electrode layer near the data-line beginning ends for data signal input, and applies the first common voltage Vcom1 to the first end 15. The first end 15 can comprise one or more points or regions of the common electrode layer near the data-line beginning ends for data signal input, and the first common voltage Vcom1 can be applied to these points or regions through leads or by other kinds of means. The second output terminal 12 is connected to a second end 16 of the common electrode layer near the data-line tail ends for data signal input, and applies the second common voltage Vcom2 to the second end 16. The second end 16 is similar to the first end 15, and can comprise one or more points or regions of the common electrode layer near the data-line tail ends for data signal input. The second common voltage Vcom2 can be applied to these points or regions through leads or by other kinds of means.

Because, on the array substrate of the liquid crystal panel 2, voltage jumps ΔV of pixel electrode voltages increase gradually from the data-line beginning ends for data signal input to the data-line tail ends for data signal input, the pixel electrode voltages decrease gradually. At the same time, the second common voltage Vcom2 is smaller than the first common voltage Vcom1. That is, similarly, along the data lines, the common voltages applied on the common electrode layer decrease gradually from the data-line beginning ends for data signal input to the data-line tail ends for data signal input. The variation trends of the pixel electrode voltages and the common voltages are consistent, so that the difference of the pixel electrode voltages and difference of the common voltages can be made as consistent as possible by adjusting the first common voltage Vcom1 and the second common voltage Vcom2, to reduce the phenomenon of flickering images of a liquid crystal display.

In the present embodiment, the common electrode drive circuit generates different common voltages and applies them onto different positions on the liquid crystal panel respectively in accordance with the different voltage jumps at respective points on the liquid crystal panel, to make variation amount for the common voltages as consistent as possible with variation amount of the voltage jumps for respective points on the liquid crystal panel, so that the entire display performance for an entire image can be largely improved.

Figure 5:
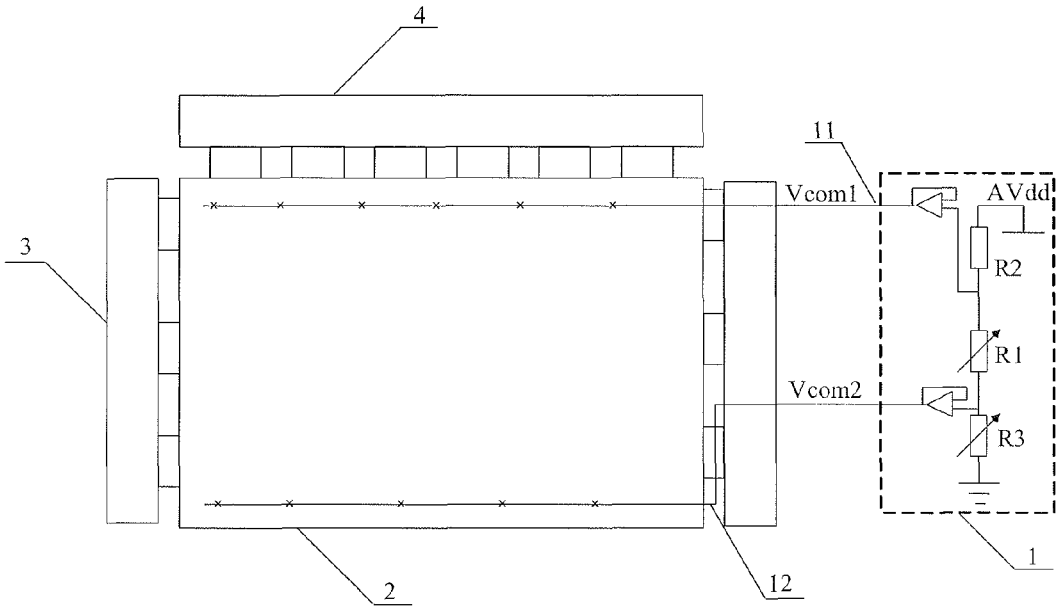
FIG. 5 is a schematic structural diagram of the second embodiment of the a common electrode drive circuit of the present invention.

FIG. 5 is a schematic structural diagram of the second embodiment of the common electrode drive circuit of the present invention. As shown in FIG. 5, in the common electrode drive circuit 1 of the present embodiment, a first resistor R1 is connected between a first electric potential (i.e., power supply voltage AVdd) output terminal and a second electric potential (i.e., grounding point) output terminal. In practice, the first electric potential output terminal and the second electric potential output terminal can also be other electric potential output terminals having preset electric potentials, so long as that the electric potential of the first electric potential output terminal is larger than the electric potential of the second electric potential output terminal. The first output terminal 11 is led out from between the first resistor R1 and the power supply voltage AVdd for output the first common electrode Vcom1; and the second output terminal 12 is led out from between the first resistor R1 and the grounding point for output the second common voltage Vcom2.

On the basis of the above configuration, a second resistor R2 can be added between the first output terminal 11 and the power supply voltage AVdd, and the first resistor R1 can be an adjustable resistor so that the value of the first common voltage Vcom1 output from the first output terminal 11 can be adjusted by adjusting the resistance of the first resistor R1. Also, a third resistor R3 can be added between the second output terminal 12 and the grounding point, and the third resistor R3 can also be an adjustable resistor, so that the value of the second common voltage Vcom2 output from the second output terminal 12 can be adjusted by adjusting the resistance of the first resistor R1 and/or the third resistor R3. The first common voltage Vcom1 and the second common voltage Vcom2 can be adjusted as long as at least one of the first resistor R1, the second resistor R2 and the third resistor R3 is an adjustable resistor. In order to make the output voltages more stable, the first common voltage Vcom1 and the second common voltage Vcom2 can be output from the first output terminal 11 and the second output terminal 12 via an operational amplifier. The voltages of the first common voltage Vcom1 and the second common voltage Vcom2 output from the operational amplifier are stable, and the influence of the internal resistance of the common electrode layer on the first common voltage Vcom1 and the second common voltage Vcom2 can be neglected.

The common electrode drive circuit of the present embodiment can be applied to a liquid crystal display and, preferably, to a liquid crystal display of a double-side gate driving form. As shown in FIG. 5, in the present embodiment, the first end can comprise a plurality of points dispersedly formed in the common electrode layer near the data-line beginning ends for data signal input, and they can be called as first common voltage input terminals here. The second end can comprise a plurality of points dispersedly formed in the common electrode layer near the data-line tail ends for data signal input, and they can be called as second common voltage input terminals. The first output terminal 11 is connected to the first common voltage input terminals of the common electrode layer near the data-line beginning ends for data signal input, and applies the first common voltage Vcom1 to the first common voltage input terminals. The first common electrode input terminals are plural in number, and distributed on a side of the common electrode layer near the data-line beginning ends for data signal input. In practice, the first output terminal 11 can be connected to these first common voltage input terminals through a plurality of leads, and applies the first common voltage Vcom1 to the first common voltage input terminals. Alternatively, a conductive band having a resistivity smaller than that of the common electrode layer can be laid at a position of the common electrode layer near the data-line beginning ends for data signal input, and the first output terminal 11 is connected to the conductive band and applies the first common voltage Vcom1 thereon. The second output terminal 12 is connected to the second common voltage input terminals of the common electrode layer near the data-line tail ends for data signal input, and applies the second common voltage Vcom2 thereto. The second common voltage input terminal are also plural in number, and distributed on a side of the common electrode layer near the data-line tail ends for data signal input. The way in which the second common voltage Vcom2 is applied to the second common voltage input terminals can be the same as the way in which the first common voltage Vcom1 is applied.

For a liquid crystal display of a double-side gate driving form, two gate drivers are provided in the liquid crystal display on two sides of the gate lines, respectively, and each of the gate lines is connected to both of the two gate drivers and is driven simultaneously by the gate drivers on both sides. In this case, differences in voltage jumps of the pixel electrode voltages on the liquid crystal panel caused by the RC characteristic of the gate lines are negligible, and the RC characteristic of the data lines on the voltage jumps needs to be taken into account. Thus, the first common voltage Vcom1 and the second common voltage Vcom2 can be input via the first common voltage input terminals near the data-line beginning ends for data signal input and the second common voltage input ends near the data-line tail ends for data signal input of the common electrode layer, respectively, in a two-step voltage input manner. As discussed above, the first common voltage input terminals are plural in number and distributed in the common electrode layer near the data-line beginning ends for data signal input, the second common voltage input terminals are plural in number and distributed in the common electrode layer near the data-line tail ends for data signal input, and the second common voltage Vcom2 is smaller than the first common voltage Vcom1. As a result, different common voltages are applied to the upper portion and the lower portion of the common electrode layer of the liquid crystal panel, and the variation trends of the common voltages and the pixel electrode voltages are consistent with each other, so that the phenomenon of flickering images of the liquid crystal display can be largely reduced.

In the present embodiment, the common electrode drive circuit applies different common voltages to the upper portion and the lower portion of the liquid crystal panel respectively in accordance with the different voltage jumps of respectively points on the liquid crystal panel, to make variation amount for the common voltages as consistent as possible with variation amount of the voltage jumps for respective points on the liquid crystal panel, so that the entire display performance for an entire image can be largely improved.

Figure 6:
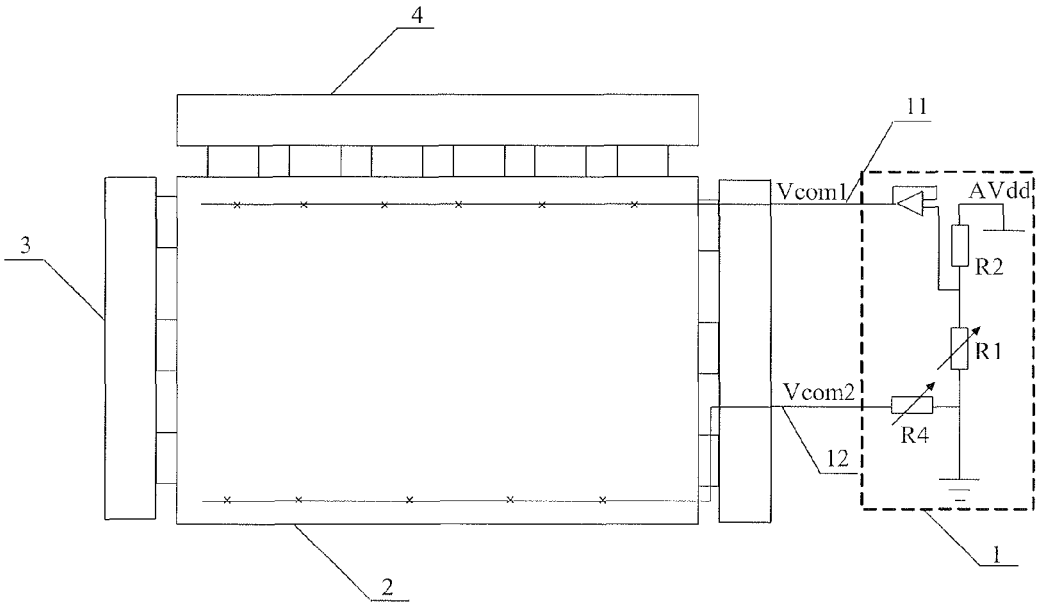
FIG. 6 is a schematic structural diagram of the third embodiment of the a common electrode drive circuit of the present invention.

FIG. 6 is a schematic structural diagram of the third embodiment of the common electrode drive circuit of the present invention. the common electrode drive circuit of the present embodiment differs mainly from the above discussed second embodiment in that, in the second embodiment, both of the first common voltage Vcom1 and the second common voltage Vcom2 are adjustable, and value of any one of the two can be affected by adjusting the value of the other one, but for the first common voltage Vcom1 and the second common voltage Vcom2 in the present embodiment, value of the first common voltage Vcom1 is not affected when the second common voltage Vcom2 is adjusted.

As shown in FIG. 6, in the common electrode drive circuit 1 of the present embodiment, a first resistor R1 and a second resistor R2 are connected in series between a first electric potential (i.e., power supply voltage AVdd) output terminal and a second electric potential (i.e., grounding point) output terminal, and the first resistor R1 is an adjustable resistor. The first output terminal 11 is led out from between the first resistor R1 and the second resistor R2, and the first common voltage Vcom1 output from the first output terminal 11 can be adjusted by adjusting the resistance of the first resistor R1. In practice, the second resistor R2 can also be an adjustable resistor. Value of the first common voltage Vcom1 can be adjusted so long as at least one of the first resistor R1 and the second resistor R2 is adjustable. If product uniformity is relatively good, both of the first resistor R1 and the second resistor R2 can be fixed resistors. Moreover, the common electrode drive circuit 1 can further comprise a fourth resistor R4, of which one end is connected to the second common voltage input terminals and the other end is connected to the second electric potential output terminal, i.e., the grounding point. As the second common voltage Vcom2 output from the second output terminal 12 is not subject to operation of an operational amplifier, and the common electrode layer has a certain internal resistance, the fourth resistor R4 and the internal resistance of the common electrode layer are effectively connected in series and divide potential between the first output terminal 11 and the second electric potential output terminal (i.e., the grounding point). The first common voltage Vcom1 output from the first output terminal 11 is higher than the second common voltage Vcom2 output from the second output terminal 12. The fourth resistor R4 is an adjustable resistor, so that value of the second common voltage Vcom2 can be adjusted by adjusting the resistance of the fourth resistor R4, and output value of the first common voltage Vcom1 will not be affected when the second common voltage Vcom2 is adjusted. If the second common voltage Vcom2 needs not to be adjusted, the fourth resistor R4 can also be a fixed resistor, and thus cost can be reduced. In order to obtain a stable driving voltage, the first common voltage Vcom1 can be output from the first output terminal 11 via an operational amplifier.

The common electrode drive circuit of the present embodiment can also be applied to a liquid crystal display and, preferably, to a liquid crystal display of the double-side gate driving form as in the second embodiment.

In the present embodiment, the common electrode drive circuit applies different common voltages to the upper portion and the lower portion of the liquid crystal panel respectively in accordance with different voltage jumps at respective points on the liquid crystal panel, to make variation amount for the common voltages as consistent as possible with variation amount of the voltage jumps for respective points on the liquid crystal panel, so that the entire display performance for an entire image can be largely improved.

Figure 7:
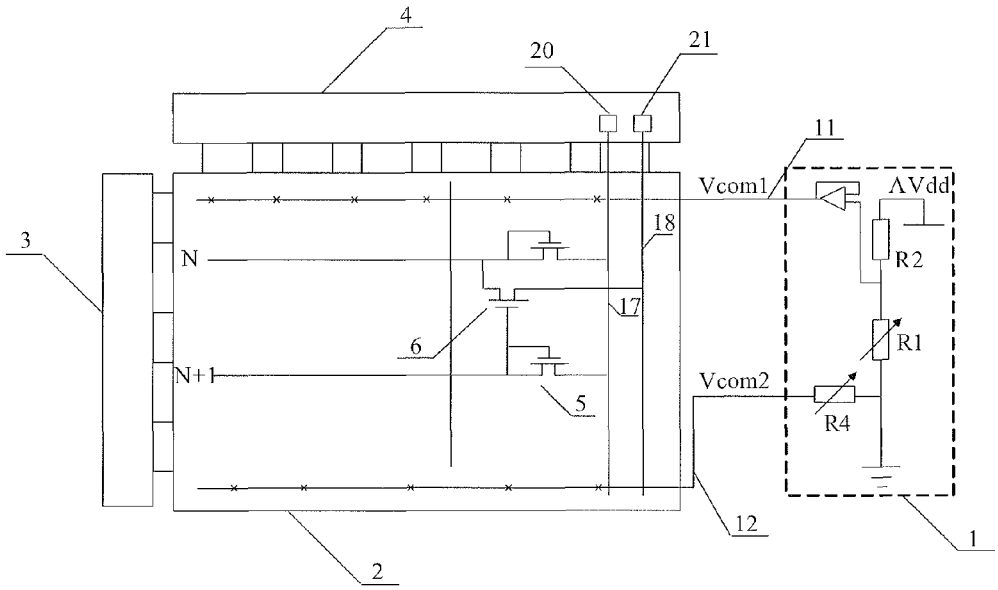
FIG. 7 is a schematic structural diagram of the fourth embodiment of the a common electrode drive circuit of the present invention.

FIG. 7 is a schematic structural diagram of the fourth embodiment of the common electrode drive circuit of the present invention. The present embodiment differs from previous embodiments mainly in that the common electrode drive circuits of the second and the third embodiments are preferably applied to a liquid crystal display of a double-side gate driving form, while the common electrode drive circuit of the present embodiment is preferably applied to a liquid crystal display of a single-side gate driving form, though an effect of double-side gate driving can be obtained with a liquid crystal display of a single-side gate driving form by designing internal structure, and therefore, the same structure as the common electrode drive circuits of previous embodiments can also be used. Of course, a liquid crystal display of a single-side gate driving form can also use the common electrode drive circuits of previous embodiments.

As shown in FIG. 7, the common electrode drive circuit of the present embodiment employs the structure of the common electrode drive circuit of the third embodiment, and other structures as discussed in previous embodiments can also be used. Thus, the details are repeated here. Now, explanation will be given as to how an effect of double-side gate driving is obtained with a liquid crystal display of a single-side gate driving form.

The liquid crystal display has one gate driver, which is provided on one side of the gate lines and connected to each of the gate lines. On the other side of the gate lines are provided a gate switching-on voltage input line 17 and a gate switching-off ("OFF") voltage input line 18, which are connected to each of the gate lines through switches respectively. In the present embodiment, the switches can be thin film transistor switches. The gate switching-on voltage input line 17 is connected with a gate switching-on voltage generator 20, and a gate switching-on voltage is input from the gate switching-on voltage generator 20 to the gate switching-on voltage input line 17. The gate switching-off voltage input line 18 is connected with a gate switching-off voltage generator 21, and a gate switching-off voltage is input from the gate switching-off voltage generator 21 to the gate switching-off voltage input line 18. The gate switching-on voltage input line 17 and the gate switching-off voltage input line 18 can be provided on the array substrate, and the gate switching-on voltage generator 20 and the gate switching-off voltage generator 21 can be provided in the data driver 4. The gate switching-on voltage and the gate switching-off voltage output from the data driver 4 are generated by circuits provided on a PCB (Printed Circuit Board) of the data driver 4, and then connected to the array substrate through leads of COF (Chip On Film). On the right side of the array substrate are provided a first thin film transistor 5 and a second thin film transistor 6. The gate and the drain electrodes of the first thin film transistor 5 are connected to the Nth gate line, and the source electrode thereof is connected to the gate switching-on voltage input line 17. The gate electrode of the second thin film transistor 6 is connected to the (N+1)th gate line, the drain electrode thereof is connected to the Nth gate line, and the source electrode thereof is connected to the gate switching-off voltage input line 18.

With the above design, an effect of double-side driving can be obtained in a single-side driving panel. The operation is explained as follows. When the Nth gate line is switched on, and the gate driver 3 inputs the gate switching-on voltage to one end of the Nth gate line, the gate electrode of the first thin film transistor 5 is switched on, and the gate switching-on voltage line 17 is turned on to input the gate switching-on voltage to the other end of the Nth gate line simultaneously, so that the same gate switching-on voltage is effectively applied to both ends of the Nth gate line simultaneously. Similarly, when the Nth gate line is switched off while the (N+1)th gate line is switched on, and the date driver 3 inputs the gate switching-off voltage to one end of the Nth gate line, the second thin film transistor 6 is switched on, and the gate switching-off voltage input line 18 is turned on to input the gate switching-off voltage to the other end of the Nth gate line simultaneously, so that the same gate switching-off voltage is effectively applied to both ends of the Nth gate line simultaneously. In this way, influence of the RC characteristic of the Nth gate line on voltage jumps ΔV at difference positions of the gate line is negligible, and influence of the RC characteristic of the data line on the voltage jumps ΔV needs to be taken into account. In this case, the manner for applying common voltage as discussed in the second and the third embodiments can be used to input different common voltages to the first common voltage input terminals (i.e., a plurality of points on the upper portion) near the data-line beginning ends for data signal input and the second common voltage input terminals (i.e., a plurality of points on the lower portion) near the data-line tail ends for data signal input of the common electrode layer of the liquid crystal panel, respectively. Thus, details will not be repeated here.

In the present embodiment, the common electrode drive circuit generates and applies different common voltages to different portions of the liquid crystal panel respectively in accordance with different voltage jumps at respective points on the liquid crystal panel, to make variation amount for the common voltages as consistent as possible with variation amount of the voltage jumps for respective points on the liquid crystal panel, so that the entire display performance for an entire image can be largely improved.

Figure 8:
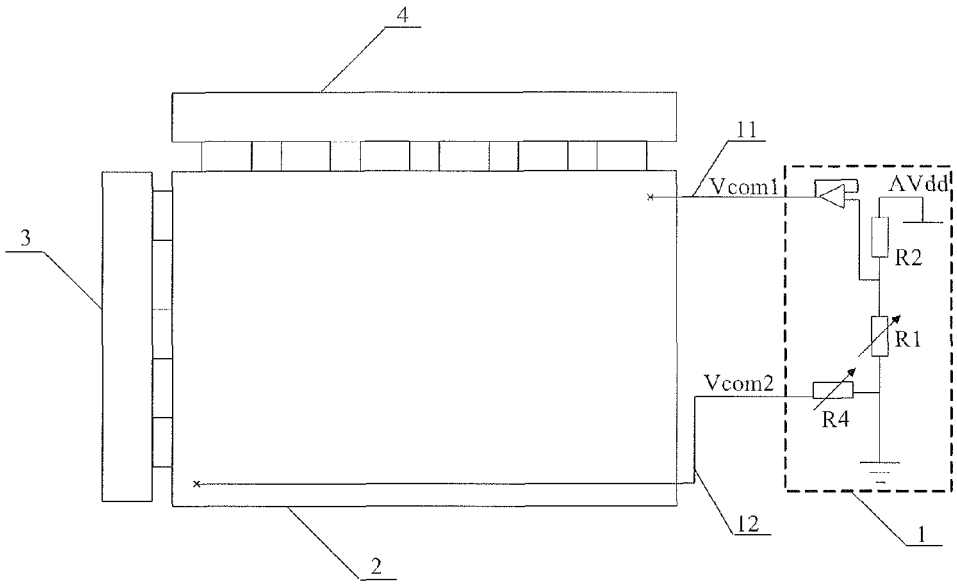
FIG. 8 is a schematic structural diagram of the fifth embodiment of the a common electrode drive circuit of the present invention.

FIG. 8 is a schematic structural diagram of the fifth embodiment of the common electrode drive circuit of the present invention. As shown in FIG. 8, the common electrode drive circuit of the present embodiment employs the structure of the common electrode drive circuit in the fourth embodiment, details of which will not be repeated here. Similar to previous embodiments, other structures can also be used.

The common electrode circuit of the present embodiment differs from the common electrode drive circuits of the previous embodiments mainly in that: in the previous embodiments, there are more than one first end and more than one second end, but in the present embodiment, there is only one first end and one second end, the first end is provided on the common electrode layer near a crossing point of the data-line beginning ends for data signal input and the gate-line tail ends for gate signal input, which may be called as the third common voltage input terminal here, and the second end is provided on the common electrode layer near a crossing point of the data-line tail ends for data signal input and the gate-line beginning ends for gate signal input, which may be called as the fourth common voltage input terminal.

The common electrode drive circuit of the present embodiment can be applied to a liquid crystal display and, preferably, to a liquid crystal display of a single-side gate driving form. A liquid crystal display of a single-side gate driving form has one gate driver which is provided on one side of gate lines and connected to each gate line to input gate signal thereto. For a liquid crystal display of such a driving form, a first output terminal 11 of the common electrode drive circuit is connected to the third common voltage input terminal of the common electrode layer near the crossing point of the data-line beginning ends for data signal input and the gate-line tail ends for gate signal input (that is, at the upper right corner), and the second output terminal 12 is connected to the fourth common voltage input terminal of the common electrode layer near the crossing point of the data-line tail ends for data signal input and the gate-line beginning ends for gate signal input (that is, at the lower left corner). By taking into account of the influence of both the RC characteristic of data lines and the RC characteristic of gate lines on voltage jump ΔV of each pixel on the liquid crystal panel, it can be seen that the voltage jump ΔV at the lower left corner is the maximum, and the voltage jump at the upper right corner is the minimum. At this point, on the basis of the influence of the RC characteristic of data lines on voltage jump, the influence of the RC characteristic of gate lines on voltage jump are also considered. That is, to make common voltages input from different common voltage input terminals of the common electrode layer increase gradually from the gate-line beginning ends for gate signal input to the gate-line tail ends for gate signal input while making the input common voltage decrease gradually from the data-line beginning ends for data signal input to the data-line tail ends for data signal input.

Accordingly, in the present embodiment, common voltages are applied in a two-step voltage input manner discussed above, in which a first common voltage Vcom1 is applied to the third common voltage input terminal at the upper right corner of the common electrode layer, a second common voltage Vcom2 is applied to the fourth common voltage input terminal at the lower left corner of the common electrode layer, and the second common voltage Vcom2 is smaller than the first common voltage Vcom1. The variation trend from the first common voltage Vcom1 to the second common voltage Vcom2 is consistent with variation trend of the pixel electrode voltages of the array substrate. The internal resistance of the common electrode layer and the fourth resistor R4 are connected in series and divide potential. Therefore values of the first common voltage Vcom1 and the second common voltage Vcom2 can be adjusted by adjusting the first resistor R1 and the fourth resistor R4, so as to make a difference between the voltages Vcom1 and Vcom2 as consistent as possible with a difference between the voltage jump ΔV1 at the third common voltage input terminal at the upper right corner and the voltage jump ΔV2 at the fourth common voltage input terminal at the lower left corner of the liquid crystal panel, thereby reducing considerably the phenomenon of flickering images of the liquid crystal display.

In the common electrode drive circuit of the present embodiment, when products of liquid crystal panels are stable, that is, when the RC characteristics of gate lines and data lines of a liquid crystal panel are consistent, a fixed resistor can be used for the fourth resistor R4 so as to reduce cost, and it is usually enough to adjust value of the first common voltage Vcom1. When liquid crystal panel products are not uniform, that is, when the RC characteristics of gate lines and data lines are caused to be not consistent due to discrepancy of liquid crystal panels and voltage jumps ΔV of respective liquid crystal panels are not consistent, the fourth resistor R4 can be set to be an adjustable resistor. In this case, by adjusting the fourth resistor R4, value of the second common voltage Vcom2 at the upper left corner can be adjusted to according to the variation of the voltage jump ΔV of the liquid crystal panel, thereby obtaining good display performance. In practical experiments, an improvement of about 2 db can be acquired. In addition, the first common voltage Vcom1 can also be output via an operational amplifier, which can make the output voltage more stable.

In the present embodiment, the common electrode drive circuit applies two different common voltages to the upper right corner and the lower left corner of the liquid crystal panel respectively in accordance with different voltage jumps at respective points on the liquid crystal panel, to make variation amount for the common voltages as consistent as possible with variation amount of the voltage jumps for respective points on the liquid crystal panel, so that the entire display performance for an image can be largely improved.

Figure 9:
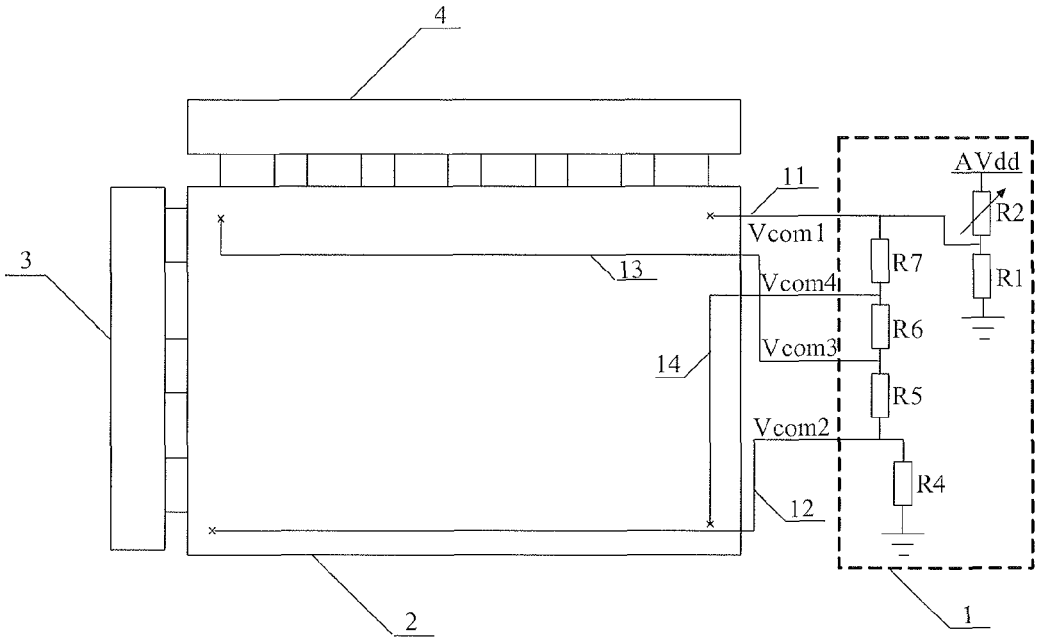
FIG. 9 is a schematic structural diagram of the sixth embodiment of the a common electrode drive circuit of the present invention.

FIG. 9 is a schematic structural diagram of the sixth embodiment of the common electrode drive circuit of the present invention. As shown in FIG. 9, the common electrode drive circuit of the present embodiment adds two common voltage output terminals on the basis of the fifth embodiment. Specifically, a third output terminal 13 and a fourth output terminal 14 are further comprised. The third output terminal 13 is connected to a fifth common voltage input terminal of the common electrode layer near a crossing point of the data-line beginning ends for data signal input and the gate-line beginning ends for gate signal input, and applies a third common voltage Vcom3 to the fifth common voltage input terminal. The fourth output terminal 14 is connected to a sixth common voltage input terminal of the common electrode layer near the data-line tail ends for data signal input and the gate-line tail ends for gate signal input, and applies a fourth common voltage Vcom4 to the sixth common voltage input terminal. Values of the third common voltage Vcom3 and the fourth common voltage Vcom4 are between those of the first common voltage Vcom1 and the second common voltage Vcom2, that is, are both larger than the second common voltage Vcom2 and smaller than the first common voltage Vcom1, and the third common voltage Vcom3 is smaller than the fourth common voltage Vcom4.

Further, on the basis of the fifth embodiment, the common electrode drive circuit of the present embodiment adds three resistors connected in series between the first output terminal 11 and the second output terminal 12, that is, a fifth resistor R5, a sixth resistor R6 and a seventh resistor R7 connected in series and dividing potential between the first output terminal 11 and the second output terminal 12. The third output terminal 13 is led out from between the fifth resistor R5 and the sixth resistor R6, and is connected to the fifth common voltage input terminal at the upper left corner of the liquid crystal panel 2 to apply the third common voltage Vcom3. The fourth output terminal 14 is led out from between the sixth resistor R6 and the seventh resistor R7, and is connected to the sixth common voltage input terminal at the lower right corner of the liquid crystal panel 2 to apply the fourth common voltage Vcom4, which is larger than the third common voltage Vcom3.

Similar to previous embodiments, in the common electrode drive circuit of the present embodiment, the first resistor R1 can also be connected between another position between the first electric potential output terminal and the second electric potential output terminal, but not between the power supply voltage AVdd and the grounding point, so long as the electric potential of the first electric potential output terminal is larger than the electric potential of the second electric potential output terminal. Any one or both of the first resistor R1 and the second resistor R2 can be an adjustable resistor, which can be used to adjust value of the first common voltage Vcom1. When liquid crystal panel products are uniform, the fourth resistor R4 can be a fixed resistor. Alternatively, the fourth resistor R4 can be an adjustable resistor, so that value of the second common voltage Vcom2 can be adjusted by adjusting the fourth resistor R4. Similar, for the fifth resistor R5, the sixth resistor R6 and the seventh resistor R7, only at least one of them needs to be an adjustable resistor to make values of the third common voltage Vcom3 and the fourth common voltage Vcom4 adjustable. In order to obtain relatively stable voltages, the first common voltage Vcom1, the second common voltage Vcom2, the third common voltage Vcom3 and the fourth common voltage Vcom4 can all be output via a respective operational amplifier.

The common electrode drive circuit of the present embodiment can be applied to a liquid crystal display and, preferably, to a liquid crystal display of a single-side gate driving form. For a liquid crystal display of a single-side gate driving form, based on consideration of the influence of the RC characteristics of gate lines and data lines on voltage jump ΔV, it is found that the voltage jump ΔV at the lower left corner of the liquid crystal panel is the maximum, that at the upper left corner is smaller, that at the lower right corner is further smaller, and that at the upper right corner is the minimum. Therefore, a four-step voltage input manner is used, in which the first common voltage Vcom1 is applied to the upper right corner of the liquid crystal panel, the second common voltage Vcom2 is applied to the lower left corner, the third common voltage Vcom3 is applied to the upper left corner, the fourth common voltage Vcom4 is applied to the lower right corner, and the third common voltage Vcom3 is smaller than the fourth common voltage Vcom4. In this way, display performance of images of a liquid crystal display can be made better.

In the present embodiment, the common electrode drive circuit applies fourth different common voltages to the upper right corner, the lower left corner, the upper left corner and the lower right corner of the liquid crystal panel respectively in accordance with different voltage jumps at respective points on the liquid crystal panel, to make variation amount for the common voltages as consistent as possible with variation amount of the voltage jumps for respective points on the liquid crystal panel, so that the entire display performance for an image can be largely improved.

Figure 10:
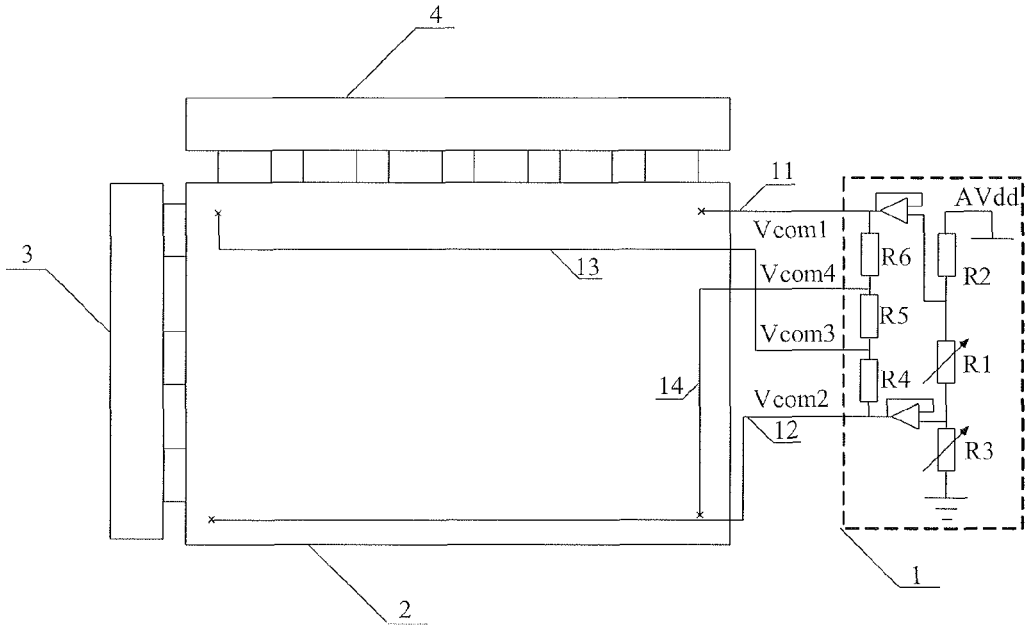
FIG. 10 is a schematic structural diagram of the seventh embodiment of the a common electrode drive circuit of the present invention.

FIG. 10 is a schematic structural diagram of the seventh embodiment of the common electrode drive circuit of the present invention. As shown in FIG. 10, the common electrode drive circuit of the present embodiment comprises also four output terminals, that is, the first output terminal 11, the second output terminal 12, the third output terminal 13 and the fourth output terminal 14, and the four output terminals 11~14 are used for the same purpose as in the sixth embodiment. The difference lies in that the structure of the common electrode drive circuit for generating common voltages for the four output terminals is different.

The common electrode drive circuit of the present embodiment adds, on the basis of the structure of the common electrode drive circuit of the second embodiment, three resistors connected in series between the first output terminal 11 and the second output terminal 12, that is, a fourth resistor R4, a fifth resistor R5 and a sixth resistor R6. The third output terminal 13 is led out from between the fourth resistor R4 and the fifth resistor R5, and the fourth output terminal is led out from between the fifth resistor R5 and the sixth resistor R6. Values of the first common voltage Vcom1 and the second common voltage vcom2 can be changed by adjusting resistances of the first resistor R1 and the third resistor R3. Also, the first common voltage Vcom1 and the second common voltage Vcom2 can be driven by an operational amplifier, so as to make the voltages stable. The fourth resistor R4, the fifth resistor R5 and the sixth resistor R6 are fixed resistors. Alternatively, at least one of the fifth resistor R5 and the sixth resistor R6 can be an adjustable resistor, so that values of the third common voltage Vcom3 and the fourth common voltage Vcom4 can be changed by adjusting resistance of the adjustable resistor.

In the present embodiment, the common electrode drive circuit applies different common voltages to four corners of the panel in accordance with different voltage jumps at respective points on the liquid crystal panel, to make variation amount for the common voltages as consistent as possible with variation amount of the voltage jumps for respective points on the liquid crystal panel, so that the entire display performance for an entire image can be largely improved.

The present invention also provides a liquid crystal display having a common electrode drive circuit as described in the above embodiments. The common electrode drive circuit of the liquid crystal display is connected with a common electrode layer for inputting common voltages into different common voltage input terminals of the common electrode layer. In the following embodiment of the liquid crystal display, the common electrode layer of the liquid crystal display is provided on a color filter substrate.

Figure 11:
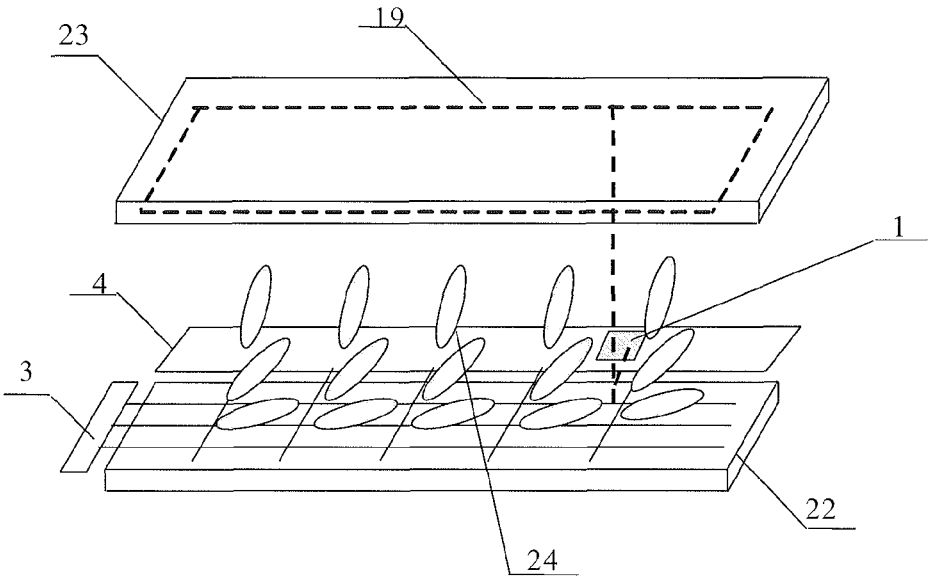
FIG. 11 is a schematic structural diagram of the first embodiment of the LCD of the present invention.

FIG. 11 is a schematic structural diagram of the first embodiment of the liquid crystal display of the present invention. As shown in FIG. 11, the liquid crystal display of the present embodiment is a liquid crystal display of a single-side gate driving form, which comprises a common electrode drive circuit 1, a liquid crystal panel, a gate driver 3 and a data driver 4. The liquid crystal panel is constituted by an array substrate 22 and a color filter substrate 23 which are assembled together with a liquid crystal layer 24 sandwiched therebetween. The array substrate 22 comprises a first substrate and a plurality of gate lines and data lines crossing each other perpendicularly on the first substrate. The color filter substrate 23 comprises a second substrate and a common electrode layer 19 formed on the second substrate. The liquid crystal display has one gate driver 3 provided on one side of the gate lines and connected to each of the gate lines for input gate signals to the gate lines. The data driver 4 input data signals to the data lines, and the common electrode drive circuit 1 is provided on the data driver 4. The common electrode drive circuit 1 is connected to the common electrode layer 19 on the color filter substrate 23 for applying common voltages to the common electrode layer 19.

The common electrode drive circuit 1 of the present invention can employ any structure as described in the first to seventh embodiments of the common electrode drive circuit.

Figure 12:
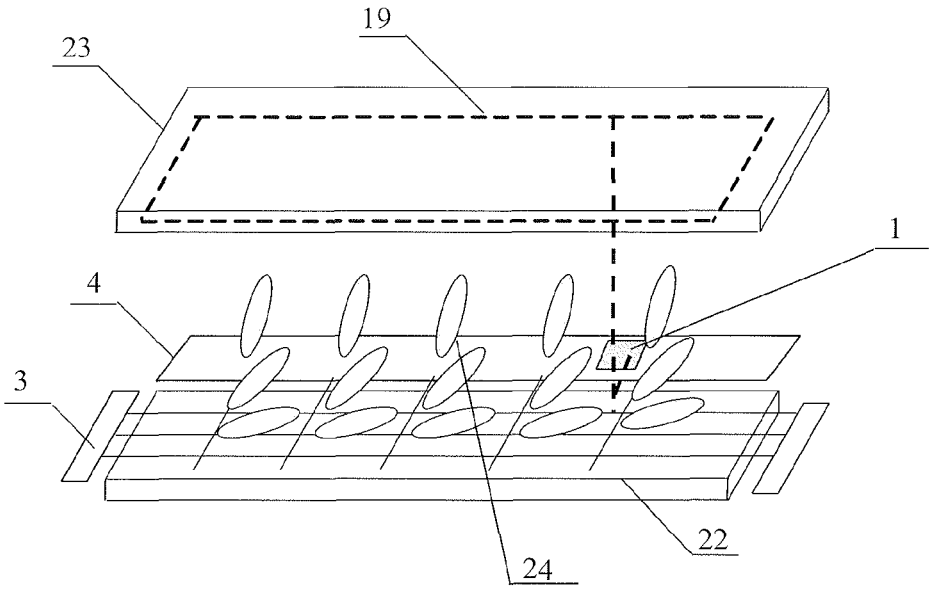
FIG. 12 is a schematic structural diagram of the second embodiment of the LCD of the present invention.

FIG. 12 is a schematic structural diagram of the second embodiment of the liquid crystal display of the present invention. As shown in FIG. 12, the present embodiment differs from the first embodiment mainly in that the liquid crystal display of the present embodiment is a liquid crystal display of a double-side gate driving form with two gate drivers 3 provided on two sides of the gate lines, and each of the gate lines is connected with both of the gate drivers 3 and is driven by both of the gate drivers 3 simultaneously.

The common electrode drive circuit 1 of the present embodiment can employ the structures described in the first to the third embodiments. That is, as the liquid crystal display of the present embodiment has a structure of a double-side gate driving form, influence of the characteristic of the gate lines on voltage jumps is negligible, and therefore, it is possible to take influence of only the data lines on voltage jumps into account and input the first common voltage and the second common voltage into the data-line beginning ends for data signal input and the data-line tail ends for data signal input, respectively.

Figure 13:
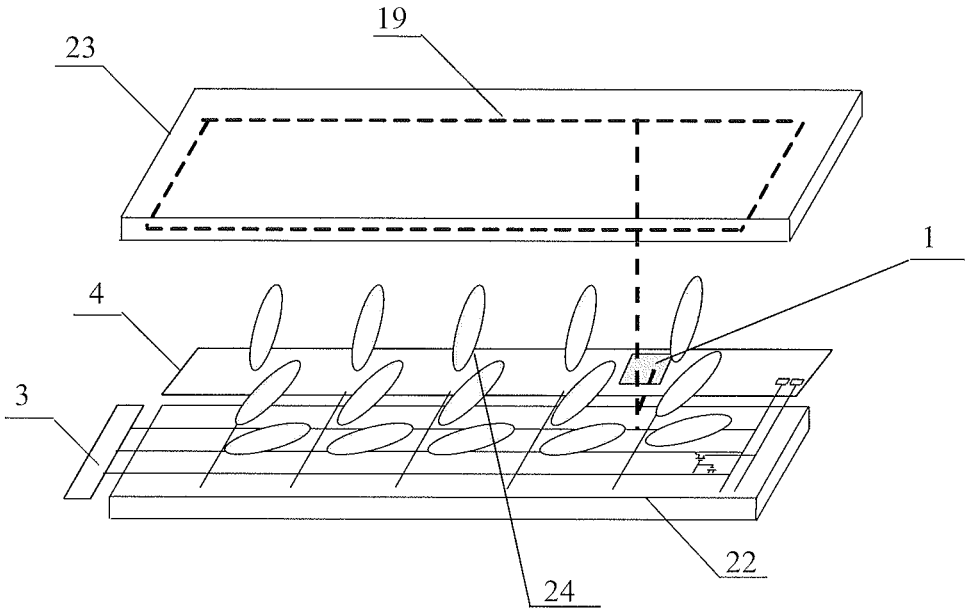
FIG. 13 is a schematic structural diagram of the third embodiment of the LCD of the present invention.

FIG. 13 is a schematic structural diagram of the third embodiment of the liquid crystal display of the present invention. As shown in FIG. 13, similar to the second embodiment, the present embodiment has also a double-side driving effect, and the common electrode drive circuit 1 can also employ the structures described in the first to the third embodiments, with which it is possible to take influence of only the data lines on voltage jumps into account and input the first common voltage and the second common voltage into the data-line beginning ends for data signal input and the data-line tail ends for data signal input, respectively.

At the same time, the present embodiment differs from the second embodiment mainly in that the liquid crystal display of the present embodiment has a structure of a single-side driving form rather than a double-side driving form, but achieves the double-side driving effect by means of structural modification. The liquid crystal display has one gate driver 3 provided on one side of the gate lines and connected with each of the gate lines. On the other side of the gate lines is provided a gate switching-on voltage input line and a gate switching-off voltage input line connected to each of the gate lines through switches. When the gate driver 3 inputs the gate switching-on voltage into one end of a gate line, the gate switching-on voltage input line is turned on and input the gate switching-on voltage into the other end of the gate line at the same time. When the gate driver 3 inputs the gate switching-off voltage into one end of a gate line, the gate switching-off voltage input line is turned on and input the gate switching-off voltage into the other end of the gate line at the same time. Detailed explanation is omitted here.

The liquid crystal displays of the above embodiments apply different common voltages onto different portions of the liquid crystal panel respectively in accordance with different voltage jumps at respective points on the panel, to make variation amount for the common voltages as consistent as possible with variation amount of the voltage jumps for respective points on the liquid crystal panel, so that the entire display performance for an image can be considerably improved, and the problem of flickering images can be reduced. Moreover, an adjustable resistor(s) can be used to facilitate adjustment of values of the common voltages, and an operational amplifier(s) can be used to make the common voltage outputs more stable.

The embodiment of the invention being thus described, it will be obvious that the same may be varied in many ways. Such variations are not to be regarded as a departure from the spirit and scope of the invention, and all such modifications as would be obvious to those skilled in the art are intended to be included within the scope of the following claims.

What is claimed is:

1. A common electrode drive circuit for driving a liquid crystal display in a Multi-Level Gate method, comprising:

a plurality of output terminals connected to a plurality of common voltage input terminals of a common electrode layer of the liquid crystal display and adapted for inputting common voltages into the plurality of common voltage input terminals, the common electrode layer driving liquid crystal together with pixel electrodes of the liquid crystal display, wherein the common voltages input by the plurality of output terminals decrease gradually from a data-line beginning end for data signal input to a data-line tail end for data signal input of the liquid crystal display;

wherein the plurality of output terminals comprise:

a first output terminal connected to a first common voltage input terminal of the common electrode layer and applying a first common voltage to the first common voltage input terminal, wherein the first common voltage input terminal is adjacent to a crossing point of the data-line beginning end for data signal input and the gate-line tail end for gate signal input;

a second output terminal connected to a second common voltage input terminal of the common electrode layer and applying a second common voltage to the second common voltage input terminal that is smaller than the first common voltage, wherein the second common voltage input terminal is adjacent to a crossing point of the data-line tail end for data signal input and the gate-line beginning end for gate signal input;

a third output terminal connected to a third common voltage input terminal of the common electrode layer and applying a third common voltage to the third common voltage input terminal, wherein the third common voltage input terminal is adjacent to a crossing point of the data-line beginning end for data signal input and the gate-line beginning end for gate signal input;

a fourth output terminal connected to a fourth common voltage input terminal of the common electrode layer and applying a fourth common voltage to the fourth common voltage input terminal, wherein the fourth common voltage input terminal is adjacent to a crossing point of the data-line tail end for data signal input and the gate-line tail end for gate signal input; and wherein the third common voltage and the fourth common voltage are both larger than the second common voltage and smaller than the first common voltage, and the third common voltage is smaller than the fourth common voltage.

2. The common electrode drive circuit of claim 1, wherein the common voltages input by the plurality of output terminals also increases gradually from a gate-line beginning end for gate signal input to a gate-line tail end for gate signal input.

3. The common electrode drive circuit of claim 1, wherein at least one of the first output terminal, the second output terminal, the third output terminal and the fourth output terminal is connected to the corresponding input terminal via an operational amplifier.

4. A liquid crystal display, comprising;

a liquid crystal panel comprising an array substrate and a color filter substrate disposed oppositely to each other with a liquid crystal layer sandwiched therebetween, the array substrate comprising a first substrate, a plurality of gate lines and a plurality of data lines crossing each other perpendicularly on the first substrate and a plurality of pixels;

a gate driver and a data driver, the gate driver outputting gate signals to the gate lines, the data driver outputting data signals to the data lines, the gate driver being provided on one side of the gate lines and connected to each of the gate lines for inputting the gate signals; and a common electrode drive circuit of claim 1 for driving in a Multi-Level Gate method.

5. The liquid crystal display of claim 4, wherein in the common electrode drive circuit, the common voltages input by the plurality of output terminals also increase gradually from a gate-line beginning end for gate signal input to a gate-line tail end for gate signal input.

6. The liquid crystal display of claim 4, further comprising another gate driver provided on the other side of the gate lines, wherein each of the gate lines is connected to both of the gate driver and the another gate driver at the same time.

7. The liquid crystal display of claim 4, wherein a gate switching-on voltage input line and a gate switching-off voltage input line are further provided on the other side of the gate lines and connected to each of the gate lines via switches;

when the gate drivers input a gate switching-on voltage into one end of a gate line, the gate switching-on voltage input line is turned on and inputs the gate switching-on voltage into the other end of the gate line at the same time;

when the gate drivers input a gate switching-off voltage into one end of a gate line, the gate switching-off voltage input line is turned on and inputs the gate switching-off voltage into the other end of the gate line; and the common electrode drive circuit is connected to the common electrode layer of the liquid crystal display.

* * * * *